US011633026B2

(12) United States Patent
Tayne

(10) Patent No.: US 11,633,026 B2
(45) **Date of Patent: *Apr. 25, 2023**

(54) MAGNETIC RETRACTABLE HANDLE

(71) Applicant: Becklin Holdings, Inc., Grants Pass, OR (US)

(72) Inventor: Adrian Tayne, Grants Pass, OR (US)

(73) Assignee: Becklin Holdings, Inc., Grants Pass, OR (US)

( * ) Notice: Subject to any disclaimer, the term of this patent is extended or adjusted under 35 U.S.C. 154(b) by 271 days.

This patent is subject to a terminal disclaimer.

(21) Appl. No.: 17/086,139

(22) Filed: Oct. 30, 2020

(65) Prior Publication Data

US 2021/0045511 A1 Feb. 18, 2021

Related U.S. Application Data

(63) Continuation of application No. 16/102,605, filed on Aug. 13, 2018, now Pat. No. 11,006,716.

(51) Int. Cl.
*A45C 13/26* (2006.01)

(52) U.S. Cl.
CPC ..... *A45C 13/26* (2013.01)

(58) Field of Classification Search
CPC ..... A45C 13/26
See application file for complete search history.

(56) References Cited

U.S. PATENT DOCUMENTS 649,832 A * 5/1900 Furnivall ..... A45C 13/26 294/149
1,883,702 A * 10/1932 Gomi ..... A45C 13/26 150/108
3,198,300 A 8/1965 Tuttle
3,664,558 A 5/1972 Tolliver
4,134,480 A 1/1979 Davis
4,733,549 A 3/1988 Baker
6,053,634 A 4/2000 Kay
6,199,737 B1 3/2001 Ringelstetter
6,669,068 B2 12/2003 Kawakita
7,610,944 B2 11/2009 Reiter
8,322,311 B2 * 12/2012 Gould ..... A01K 27/003 119/797
8,408,791 B1 4/2013 Wang
9,730,507 B2 * 8/2017 Wendler ..... A45F 3/02
(Continued)

FOREIGN PATENT DOCUMENTS

FR 2 716 608 9/1995

OTHER PUBLICATIONS

International Search Report and Written Opinion of the International Searching Authority dated Aug. 15, 2019, in International Patent Application No. PCT/US19/33008, 7 pages.

*Primary Examiner* — Tri M Mai
(74) *Attorney, Agent, or Firm* — Lowe Graham Jones PLLC

(57) ABSTRACT

A handle assembly include right and left straps secured to a handle, the right and left straps each have first magnetic elements secured thereto. A case has second magnetic elements mounted thereto, such mounted to the case with a portion of the right or left strap secured between itself and the case. The magnetic attraction between the first and second magnetic elements draws the handle toward the case. The case may define a recess such that the handle is drawn into the recess and does not protrude.

20 Claims, 2 Drawing Sheets

(56) References Cited

U.S. PATENT DOCUMENTS

| | | | | |
|---|---|---|---|---|
| 10,136,712 | B2 | 11/2018 | Taylor-Phillips | |
| 2006/0269172 | A1* | 11/2006 | Godshaw ..... | A45C 13/00<br>383/104 |
| 2009/0101252 | A1 | 4/2009 | Bundrick et al. | |
| 2011/0240704 | A1 | 10/2011 | Smith | |
| 2013/0047380 | A1 | 2/2013 | Huang et al. | |
| 2015/0223585 | A1 | 8/2015 | Worrell et al. | |
| 2015/0313337 | A1 | 11/2015 | Swartzel | |

* cited by examiner

MAGNETIC RETRACTABLE HANDLE

PRIORITY CLAIM

This application is a continuation of U.S. patent application Ser. No. 16/102,605 filed Aug. 13, 2018, which is incorporated herein by reference in its entirety.

FIELD OF THE INVENTION

This application relates to handles for cases.

BACKGROUND OF THE INVENTION

Various types of containers, which may take the form of transit containers, rack-mount containers, tote containers or another type of container, are often utilized to receive and support delicate cargo, such as, but not limited to electronic, computer, optical and other types of equipment. These containers are often used in military and commercial environments and may be handled by persons, loading equipment, or both during transit and at other times. At least some of these containers have been designed to be stackable, and thus they include stacking elements or features arranged in a desired pattern. Cases and luggage that are designed to be carried onto a commercial airplane must comply with dimensional size limits established by each airline company.

It would be an improvement in the art to improve the usability of a case performing the above-mentioned functions.

SUMMARY OF THE INVENTION

In one aspect of the invention an apparatus includes a case and a handle assembly secured to the case. The handle assembly includes a handle; a left strap secured to the handle and the case; and a right strap secured to the handle opposite the left strap and secured to the case. A first left element is secured to the left strap and a second left element is secured to the case, the first left element and second left element having a magnetic attraction to one another. A first right element is secured to the right strap a second right element is secured to the case, the first right element and second right element having a magnetic attraction to one another.

In some embodiments, a first portion of the left strap is secured to the case and the second left element is secured to the case having the first portion between the second left element and the case.

In some embodiments, a plurality of fasteners secure a first portion of the left strap to the case, the second left element secured to the case having the first portion between the second left element and the case. The plurality of fasteners may be distributed uniformly around the second left element. The plurality of fasteners may include at least four fasteners. The plurality of fasteners may be rivets.

In some embodiments, the left strap includes a second portion extending from the first portion to the handle, the second portion being folded when the first left element is in contact with the second left element.

In some embodiments, the case defines a recess, the left strap and the right strap secured to the case within the recess. A depth of the recess is such that the handle does not protrude outside of the recess when the first left element is contacting the second left element and the first right element is contacting the second right element.

In some embodiments at least one of the following is true: (a) the first left element includes a magnet and the second left element includes a ferromagnetic material; (b) the first left element includes a magnet and the second left element includes a magnet; and (c) the first left element includes a ferromagnetic material and the second left element includes a magnet.

In another aspect of the invention, a method includes providing a case and a handle assembly secured to the case. The handle assembly includes a handle; a left strap secured to the handle and the case; a right strap secured to the handle opposite the left strap and secured to the case. A first left element is secured to the left strap. A second left element is secured to the case, the first left element and second left element having a magnetic attraction to one another. A first right element is secured to the right strap. A second right element is secured to the case, the first right element and second right element having a magnetic attraction to one another.

The method includes drawing the handle inwardly by the magnetic attraction of the first left element to the second left element and the magnetic attraction of the first right element to the second right element.

The method may further include grasping the handle by a user effective to withdraw the handle and separate the first left element from the second left element and separate the first right element from the second right element.

In some embodiments, the case defines a recess, the left strap and the right strap are secured to the case within the recess. The method may include drawing the handle into the recess by the magnetic attraction of the first left element to the second left element and the magnetic attraction of the first right element to the second right element. In some embodiments, drawing the handle into the recess includes drawing the handle inwardly such that no portion of the handle protrudes outside of the recess. In some embodiments, a depth of the recess is such that the handle does not protrude outside of the recess when the first left element is contacting the second left element and the first right element is contacting the second right element.

In some embodiments, a first portion of the left strap is secured to the case, the second left element is secured to the case having the first portion between the second left element and the case. The left strap includes a second portion extending from the first portion to the handle. Drawing the handle inwardly by the magnetic attraction of the first left element to the second left element and the magnetic attraction of the first right element to the second right element further includes folding the second portion.

In some embodiments, a plurality of fasteners secure a first portion of the left strap to the case, the second left element secured to the case having the first portion between the second left element and the case. The plurality of fasteners may be distributed uniformly around the second left element. In some embodiments, the second portion protrudes away from the handle and the first portion when folded.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
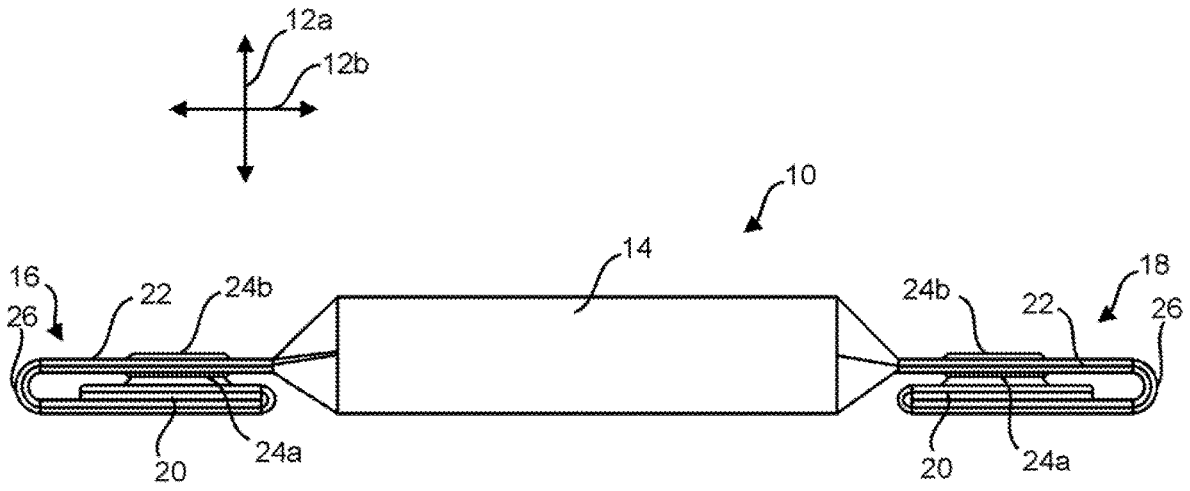
FIG. 1 is a side view of a retractable handle in an extended position in accordance with an embodiment of the present invention.

Referring to FIG. 1, a handle assembly 10 may be understood with respect to a vertical direction 12*a* and a horizontal direction 12*b* that are perpendicular to one another. The directions 12*a*, 12*b* are defined to facilitate understanding of the relative orientation and position of elements of the disclosed embodiments but need not correspond to actual vertical and horizontal directions when in use. A longitudinal direction 12*c* (see FIGS. 3 and 4) may be defined as perpendicular to both the vertical direction 12*a* and the horizontal direction 12*b*.

The handle assembly 10 includes a handle 14. The handle 14 may have an oblong shape with the long dimension oriented substantially parallel (e.g., within 15 degrees) to the horizontal direction 12*b*.

A left strap 16 and a right strap 18 are secured to the handle such that a major portion (preferably at least 80 percent) of the handle 14 is positioned between a point where the left strap 16 emanates from the handle 14 and a point where the right strap 18 emanates from the handle. In some embodiments, the left and right straps 16, 18 are portions of a single strap. For example, the handle 14 may be made of two or more pieces that secure around the single strap or the handle may define a passage through which the single strap passes. The straps 16, 18 may be any suitable strap material, such as nylon webbing, solid strips of polymer, other type of woven fibers whether natural or synthetic, leather, metal chain or mesh, or any other material having sufficient strength and flexibility to perform the functions ascribed herein to the straps 16, 18.

The handle 14 may be a rod having a circular, elliptical, or other cross section perpendicular to the long dimension thereof. The handle 14 may have indentations for fingers and have any features of any handle known in the art.

The left strap 16 and right strap 18 may each include a first portion 20 and a second portion 22. The first portion 20 secures to an entity to which the handle assembly 10 is secured, such as a case, luggage, or other entity. The second portion 22 secures between the first portion 20 and the handle 14. In the illustrated embodiment, the first portion is folded such that two layers of strap material are secured to the entity. In the illustrated embodiment, the second portion 22 emanates from an outboard edge of the first portion 20 for both of the straps 16, 18.

An element 24*a* secures to one of the first portion 20 and the entity to which the first portion 20 is secured. In the illustrated embodiment, the element 24*a* is secured to the entity having the first portion 20 positioned between itself and the entity. A second element 24*b* secures to the second portion 22 at a point along the length of the second portion that is between the handle 14 and the first portion 20. In the illustrated embodiment, the element 24*b* secures to the second portion 22 closer to the handle along the length of the second portion 22 than to a point of attachment of the first portion to the entity, e.g. a length of the second portion 22 between the handle and a center of the element 24*b* may be less than or equal to one third of a free length of the second portion 22 from a point at which the second portion 22 emanates from the handle 14 to where the free length of the second portion 22 emanates from a point of attachment of the first portion 20 to the entity.

The element 24*a* and the element 24*b* have a magnetic attraction to one another. This may be achieved by any of the following approaches:

- Element 24*a* includes a magnet and element 24*b* includes a ferromagnetic material (iron, cobalt, etc.).
- Element 24*a* includes a magnet and element 24*b* includes a magnet.
- Element 24*a* includes a ferromagnetic material and element 24*b* includes a magnet.

Elements 24*a*, 24*b* may include a magnet or ferromagnetic material encased in another material, such as plastic to facilitate securement of the element 24*a*, 24*b* to the straps 16, 18. For example, elements 24*a*, 24*b* may include grommets, flanges, or other structures for securement to the straps 16, 18. The straps 16, 18 may define holes within which the elements 24*a*, 24*b* secure.

Figure 2:
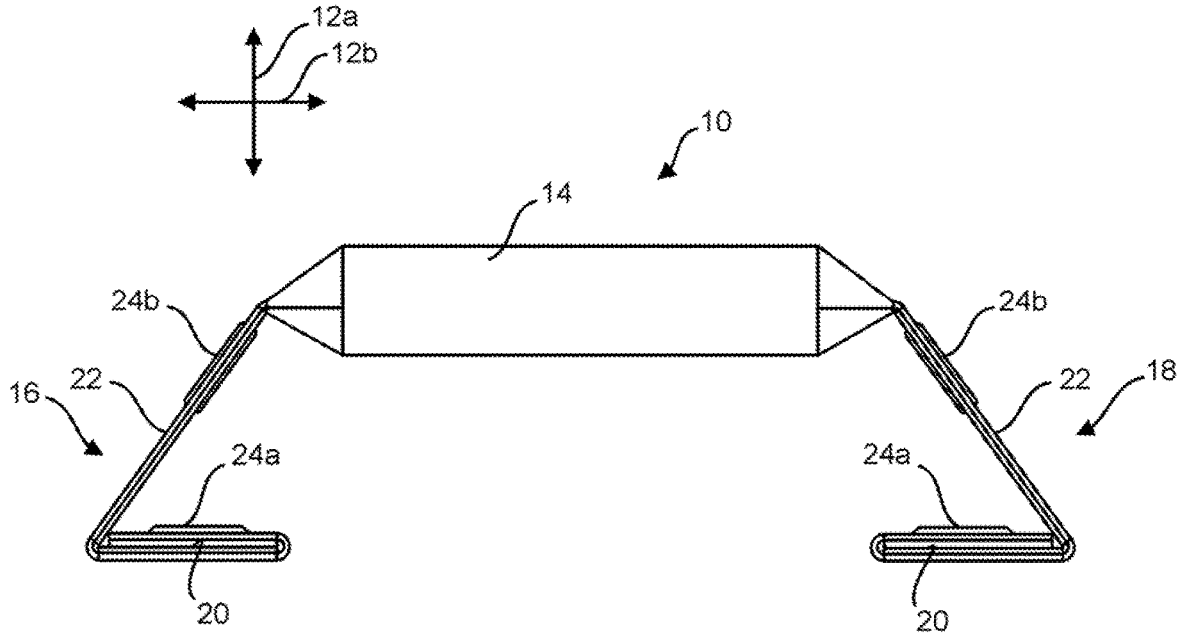
FIG. 2 is a side view of the retractable handle in a retracted position in accordance with an embodiment of the present invention.

Referring to FIG. 2, when not in use, the magnetic attraction between the first element 24*a* and the second element 14*b* causes the straps 16, 18 to bend and draw the handle 24 inwardly along the vertical direction. This ensures that when the handle 14 is not in use it is less likely to snag on other items or otherwise get in the way. When in the retracted position shown in FIG. 1, the second portion 22 bends such that the bent portion 26 protrudes outwardly having the elements 24*a*, 24*b* positioned between the bent portion 26 and the handle 14. In other embodiments, the bent portion 28 may protrude inwardly. This may limit the amount of retraction but may still be acceptable in some applications.

When ready to carry the entity to which the handle assembly 10 is mounted, a user may then grasp the handle 14 and pull the elements 24*a*, 24*b* apart on the straps 16, 18. The handle 14 will then be in the extended position of FIG. 1, allowing the user's fingers and hand to encircle the handle 14.

Figure 3:
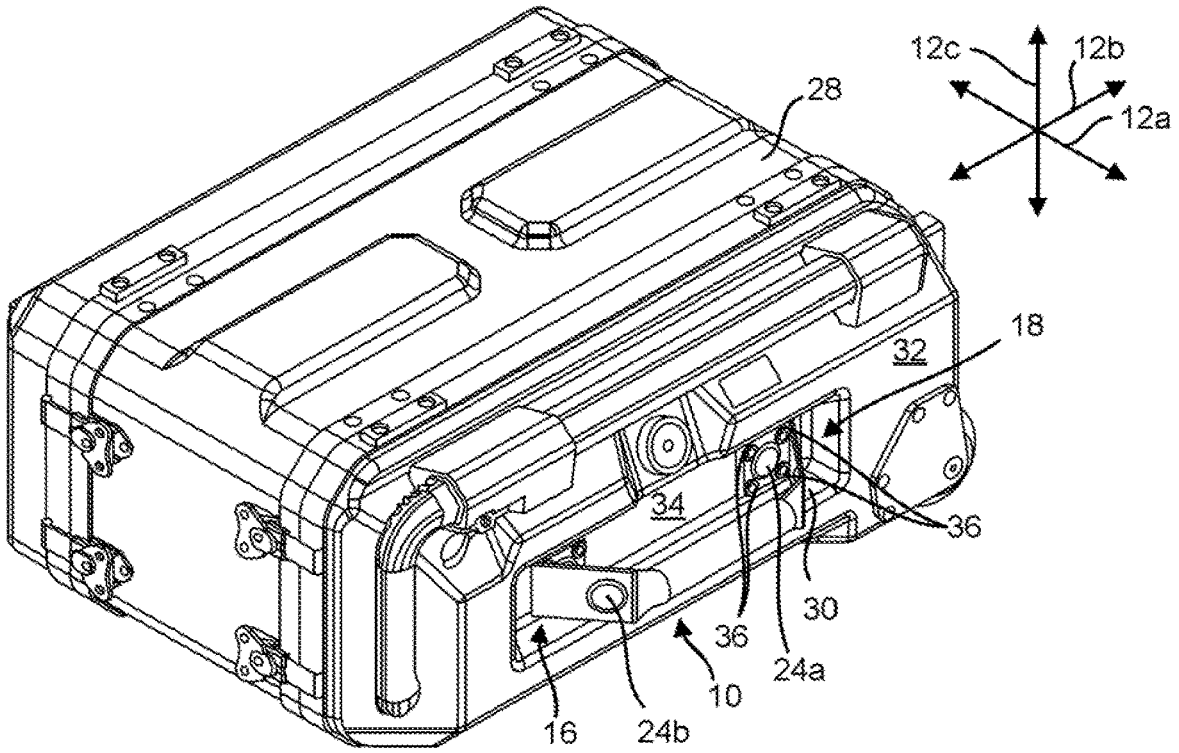
FIG. 3 is an isometric view of a case having the retractable handle secured thereto and in the extended position.
Figure 4:
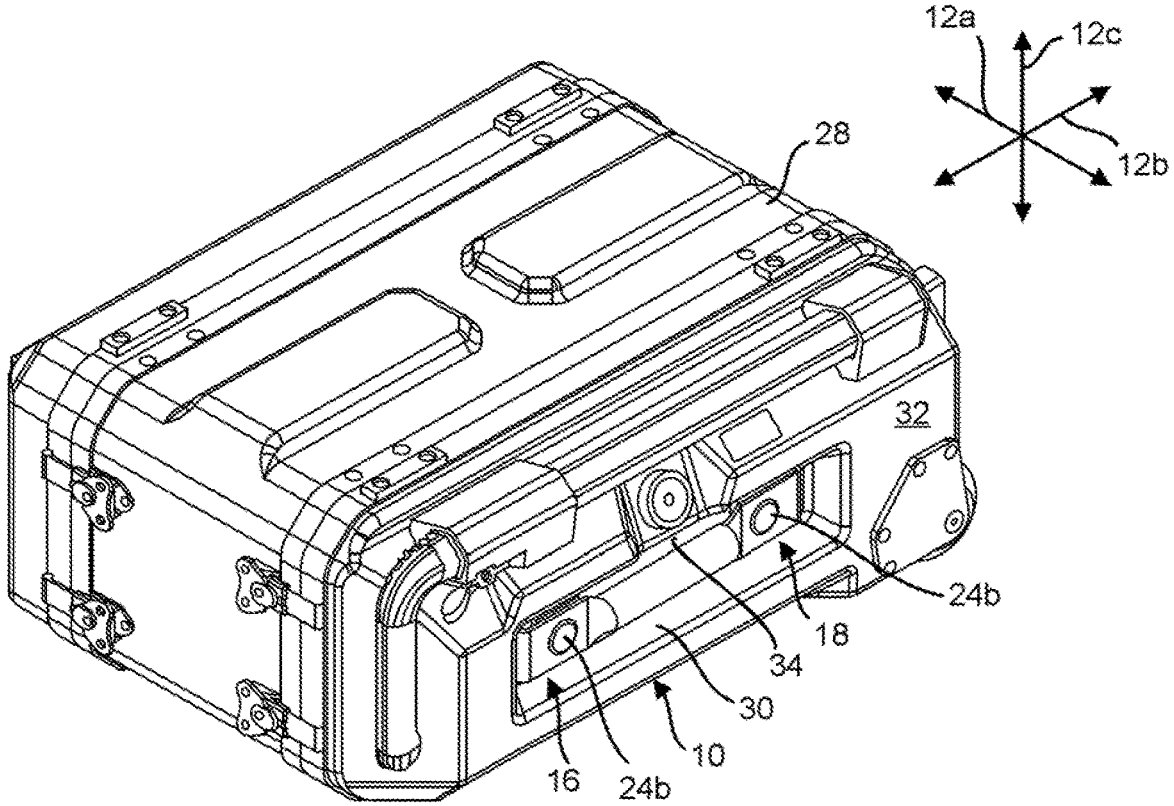
FIG. 4 is an isometric view of the case having the retractable handle secured thereto in the retracted position.

Referring to FIGS. 3 and 4, the entity may be a case 28 having a generally cuboid shape. FIG. 3 illustrates the handle assembly 10 secured to the case 28 with the handle 14 in the extended position. FIG. 4 illustrates the handle assembly 10 secured to the case 28 with the handle 14 in the retracted position. In the illustrated embodiment, the case 28 is a rigid case with rollers and a telescoping handle. However, any other type of case, including soft-sided cases may benefit from the handle assembly 10.

In the illustrated embodiment, the case 28 defines a recess 30, such as a recess 30 extending inwardly into the case from a panel 32 of the case 28. The first portions 20 of the straps 16, 18 may mount on a floor 34 of the recess 30. The floor 32 is preferably recessed sufficiently such that the handle 14 does not protrude out of the recess 30 when in the retracted position, e.g. is below the panel 32 along the vertical direction 12*a*. The recess 32 is preferably shallow enough relative to the length of the second portions 22 of the straps 16, 18 that the entirety of the handle 14 is positioned outside of the recess 30 when in the extended position, e.g. vertically above the panel 32 along the vertical direction 12*b*.

In the illustrated embodiment, the first portions 20 of the straps 16, 18 secure to the case by means of rivets 36. As shown, a plurality of rivets 36 (e.g., 4) are used such that the rivets 36 are distributed around the element 20.

In the illustrated embodiment, the length of the recess 30 in the horizontal direction 12*b* may be greater than the length of the handle assembly in the retracted position, e.g. such that, when the handle 14 is retracted, the bent portions 26 of the first portions 22 don't contact walls of the recess 30 extending between the floor 34 and the panel 32. For example, the length of the recess in the horizontal direction 12*b* may be between 90 and 110 percent of the length of the handle assembly 10 in the retracted position in the absence of any constraint in the horizontal direction 12*b*.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus comprising:
a case; and
a handle assembly secured to the case and including:
a handle;
a left strap secured to the handle and the case;
a right strap secured to the handle opposite the left strap and secured to the case;
a first left element secured to the left strap;
a second left element secured to the case, the first left element and second left element having a magnetic attraction to one another;
a first right element secured to the right strap; and
a second right element secured to the case, the first right element and second right element having a magnetic attraction to one another;
wherein when the first left element is engaged with the second left element, a portion of the left strap is folded over and positioned to the left of the second left element; and
wherein when the first right element is engaged with the second right element, a portion of the right strap is folded over and positioned to the right of the second right element.

2. The apparatus of claim 1, wherein a first portion of the left strap is secured to the case, the second left element secured to the case having the first portion between the second left element and the case.

3. The apparatus of claim 1, wherein a plurality of fasteners securing a first portion of the left strap to the case, the second left element secured to the case having the first portion between the second left element and the case.

4. The apparatus of claim 3, wherein the plurality of fasteners are distributed uniformly around the second left element.

5. The apparatus of claim 4, wherein the plurality of fasteners comprise at least four fasteners.

6. The apparatus of claim 5, wherein the plurality of fasteners are rivets.

7. The apparatus of claim 3, wherein the left strap includes a second portion extending from the first portion to the handle, the second portion being folded when the first left element is in contact with the second left element.

8. The apparatus of claim 1, wherein the case defines a recess, the left strap and the right strap secured to the case within the recess.

9. The apparatus of claim 8, wherein a depth of the recess is such that the handle does not protrude outside of the recess when the first left element is contacting the second left element and the first right element is contacting the second right element.

10. The apparatus of claim 1, wherein at least one of:
(a) the first left element includes a magnet and the second left element includes a ferromagnetic material;
(b) the first left element includes a magnet and the second left element includes a magnet; and
(c) the first left element includes a ferromagnetic material and the second left element includes a magnet.

11. A method comprising:
providing a case;
providing a handle assembly secured to the case and including:
a handle;
a left strap secured to a lift side of the handle and the case;
a right strap secured to right side of the handle opposite the left strap and secured to the case;
a first left element secured to the left strap;
a second left element secured to the case, the first left element and second left element having a magnetic attraction to one another;
a first right element secured to the right strap; and
a second right element secured to the case, the first right element and second right element having a magnetic attraction to one another; and
drawing the handle inwardly by the magnetic attraction of the first left element to the second left element and the magnetic attraction of the first right element to the second right element such that a portion of the left strap is folded over and positioned to the left of the first left element and the second left element and a portion of the right strap is folded over and positioned to the right of the first right element and the second right element.

12. The method of claim 11, further comprising:
grasping the handle by a user effective to withdraw the handle and separate the first left element from the second left element and separate the first right element from the second right element.

13. The method of claim 12, wherein the case defines a recess, the left strap and the right strap secured to the case within the recess, wherein drawing the handle inwardly by the magnetic attraction of the first left element to the second left element and the magnetic attraction of the first right element to the second right element comprises drawing the handle into the recess.

14. The method of claim 12, wherein the case defines a recess, the left strap and the right strap secured to the case within the recess, wherein drawing the handle inwardly by the magnetic attraction of the first left element to the second left element and the magnetic attraction of the first right element to the second right element comprises drawing the handle into the recess such that no portion of the handle protrudes outside of the recess.

15. The method of claim 11, wherein:
a first portion of the left strap is secured to the case, the second left element secured to the case having the first portion between the second left element and the case;
the left strap includes a second portion extending from the first portion to the handle; and
drawing the handle inwardly by the magnetic attraction of the first left element to the second left element and the magnetic attraction of the first right element to the second right element further comprises folding the second portion.

16. The method of claim 15, wherein a plurality of fasteners secure a first portion of the left strap to the case, the second left element secured to the case having the first portion between the second left element and the case.

17. The method of claim 16, wherein the plurality of fasteners are distributed uniformly around the second left element.

18. The method of claim 15, wherein the second portion protrudes away from the handle and the first portion when folded.

19. The method of claim 11, wherein at least one of:

(a) the first left element includes a magnet and the second left element includes a ferromagnetic material;

(b) the first left element includes a magnet and the second left element includes a magnet; and (c) the first left element includes a ferromagnetic material and the second left element includes a magnet.

20. An apparatus comprising:

a case, the case being rigid; and a handle assembly secured to the case and including:

a handle, the handle being rigid;

a left strap secured to the handle and the case;

a right strap secured to the handle opposite the left strap and secured to the case;

a first left element secured to the left strap;

a second left element secured to the case, the first left element and second left element having a magnetic attraction to one another;

a first right element secured to the right strap; and a second right element secured to the case, the first right element and second right element having a magnetic attraction to one another;

wherein the left strap is secured to the case between the second left element and the case;

wherein the right strap is secured to the case between the second right element and the case;

wherein the left strap extends outwardly to the left of the second left element and then inwardly to the right of the second left element to the handle;

wherein the right strap extends outwardly to the right of the second right element and then inwardly to the left of the second right element to the handle;

wherein when the first left element is engaged with the second left element, a portion of the left strap is folded over and positioned to the left of the second left element; and wherein when the first right element is engaged with the second right element, a portion of the right strap is folded over and positioned to the right of the second right element.

* * * * *